US009540737B2

(12) United States Patent
Botte

(10) Patent No.: US 9,540,737 B2
(45) Date of Patent: Jan. 10, 2017

(54) ELECTROCHEMICAL SYNTHESIS OF AMMONIA IN ALKALINE MEDIA

(71) Applicant: Ohio University, Athens, OH (US)

(72) Inventor: Gerardine G. Botte, Athens, OH (US)

(73) Assignee: Ohio University, Athens, OH (US)

( * ) Notice: Subject to any disclaimer, the term of this patent is extended or adjusted under 35 U.S.C. 154(b) by 0 days.

(21) Appl. No.: 14/778,627

(22) PCT Filed: Mar. 26, 2014

(86) PCT No.: PCT/US2014/031887

§ 371 (c)(1),
(2) Date: Sep. 21, 2015

(87) PCT Pub. No.: WO2014/160792

PCT Pub. Date: Oct. 2, 2014

(65) Prior Publication Data

US 2016/0083853 A1 Mar. 24, 2016

Related U.S. Application Data

(60) Provisional application No. 61/805,366, filed on Mar. 26, 2013.

(51) Int. Cl.
*C25B 1/00* (2006.01)
*C25B 11/04* (2006.01)
(Continued)

(52) U.S. Cl.
CPC . *C25B 1/00* (2013.01); *C25B 9/08* (2013.01); *C25B 11/04* (2013.01); *C25B 13/00* (2013.01)

(58) Field of Classification Search
CPC ..... C25B 1/00; C25B 13/00; C25B 9/08; C25B 11/04
See application file for complete search history.

(56) References Cited

U.S. PATENT DOCUMENTS 7,485,211 B2 2/2009 Botte et al.
7,803,264 B2 9/2010 Botte
(Continued)

OTHER PUBLICATIONS

Furuya N et al: "Electroreduction of nitrogen to ammonia on gas-diffusion electrodes modified by Fe-phthalocyanine", Journal of Electroanalytical Chemistry and Interfacial Electrochemistry, Elsevier, Amsterdam, NL, vol. 263, No. 1, May 10, 1989 (May 10, 1989), pp. 171-174, XP026517742, ISSN: 0022-0728, DOI: 10.1016/0022-0728(89)80134-2 [retrieved on May 10, 1989].
(Continued)

*Primary Examiner* — Arun S Phasge
(74) *Attorney, Agent, or Firm* — Wood Herron & Evans LLP

(57) ABSTRACT

A method is provided for an electrochemical synthesis of ammonia in alkaline media. The method electrolytically converts $N_2$ and $H_2$ to $NH_3$ in an electrochemical cell comprising an anode, a cathode, and an alkaline electrolyte. The method includes exposing an anode to a $H_2$-containing fluid, wherein the anode is active toward adsorption and oxidation of $H_2$; exposing a cathode to a $N_2$-containing fluid, wherein the cathode is active toward adsorption and reduction of $N_2$ to form $NH_3$; and applying a voltage between the anode and the cathode so as to facilitate adsorption of hydrogen onto the anode and adsorption of nitrogen onto the cathode; wherein the voltage is sufficient to simultaneously oxidize the $H_2$ and reduce the $N_2$. The electrolytic method is performed with the $H_2$ and $N_2$ pressures from about 10 atmospheres (atm) to about 1 atm; and at temperatures from about 25° C. to about 205° C.

16 Claims, 4 Drawing Sheets

(51) Int. Cl.
*C25B 9/08* (2006.01)
*C25B 13/00* (2006.01)

(56) References Cited

U.S. PATENT DOCUMENTS

| | | | |
|---|---|---|---|
| 8,216,956 | B2 | 7/2012 | Botte |
| 2005/0211569 | A1 | 9/2005 | Botte et al. |

OTHER PUBLICATIONS

Furuya N et al: "Electroreduction of nitrogen to ammonia on gas-diffusion electrodes modified by metal phthalocyanines", Journal of Electroanalytical Chemistry and Interfacial Electrochemistry, Elsevier, Amsterdam, NL, vol. 272, No. 1-2, Nov. 10, 1989 (Nov. 10, 1989), pp. 263-266, XP026532688, ISSN: 0022-0728, DOI: 10.1016/0022-0728(89)87086-X [retrieved on Nov. 10, 1989].

Furuya N et al: "Electroreduction of nitrogen to ammonia on gas-diffusion electrodes loaded with inorganic catalyst", Journal of Electroanalytical Chemistry and Interfacial Electrochemistry, Elsevier, Amsterdam, NL, vol. 291, No. 1-2, Sep. 25, 1990 (Sep. 25, 1990), pp. 269-272, XP026533170, ISSN: 0022-0728, DOI: 10.1016/0022-0728(90)87195-P [retrieved on Sep. 25, 1990].

Shu-Yong Zhang et al: "Electroreduction Behavior of Dinitrogen over Ruthenium Cathodic Catalyst", Chemistry Letters, vol. 32, No. 5, Jan. 1, 2003 (Jan. 1, 2003), pp. 440-441, XP055130707, ISSN: 0366-7022, DOI: 10.1246/cl.2003.440.

Ramasamy Palaniappan et al: "Efficacy of potassium poly(acrylate) gel electrolyte as a substitute to aqueous electrolytes for alkaline ammonia electrolysis", Electrochimica Acta, vol. 88, Nov. 5, 2012 (Nov. 5, 2012), pp. 772-781, XP055130476, ISSN: 0013-4686, DOI: 10.1016/j.electacta.2012.10.023 Chinese Journal of Chemistry vol. 28, 2010, pp. 139-142.

International Search Report and Written Opinion from corresponding PCT Appln PCT/US2014/031887 mailed Aug. 11, 2014.

ELECTROCHEMICAL SYNTHESIS OF AMMONIA IN ALKALINE MEDIA

CROSS-REFERENCE TO RELATED APPLICATIONS

This application is a submission under 35 USC §371 of International Application No. PCT/US2014/031887, filed Mar. 26, 2014, which claims priority to Provisional Application No. 61/805,366 filed Mar. 26, 2013, the disclosures of which are expressly incorporated herein by reference in their entirety.

FIELD OF THE INVENTION

The invention relates generally to the electrochemical synthesis of ammonia in alkaline media.

BACKGROUND

One of the most widely produced chemicals worldwide is ammonia, which has applications as a fertilizer, a hydrogen storage media, and as a reactant in selective catalytic reduction of combustion gases from vehicles and stationary facilities, amongst many others.

The Haber (or Haber-Bosch) process is the principle manufacturing method for synthesizing ammonia. In the Haber process, ammonia is synthesized from nitrogen and hydrogen gas according to the following reaction:

$$N_3+3H_2 \rightarrow 2NH_3 \qquad \text{Equation (1)}$$

The Haber process employs an iron-based catalyst and operates at high temperatures (e.g., above about 430° C. (about 806° F.)) and high pressures (e.g., above about 150 atmospheres (about 2,200 pounds per square inch)), which lead to high-energy consumption. In addition, the ammonia conversions are relatively low, e.g., between about 10% and about 15%.

Due to these extreme process limitations, several researchers have investigated the synthesis of ammonia through an electrochemical approach. However, thus far, all the electrochemical routes presented in the literature had been performed in the solid state, which implies the use of solid and/or composite electrolytes. Therefore, the transport of the ions is limited by temperature. The electrochemical reactions reported in the literature are based on the transport of protons in which the reduction of nitrogen takes place according to:

$$N_2+6H^++6e^- \rightarrow 2NH_3 \qquad \text{Equation (2)}$$

while the oxidation of hydrogen takes place according to:

$$3H_2 \rightarrow 6H^++6e^- \qquad \text{Equation (3)}$$

Operating temperatures in the different systems that have been described in the literature range from 480° C. to 650° C., using perovskite-type, pyrochlore-type, and fluorite-type solid-state proton conductors as electrolytes. In addition to the high operating temperatures, the ammonia formation rates are low, with the highest reported rate in the order of $10^{-5}$ mol/s $m^2$. Lower temperatures have been achieved with the use of Nafion®-type membranes allowing ammonia formation rates in the order of $1\times10^{-4}$ mol/s $m^2$ at 80° C. to 90° C. However, the operating voltages for the cell are high, in the order of 2.0 V, which represents a high energy consumption for the synthesis.

In view of the foregoing, there is a need for new methods for synthesizing ammonia.

SUMMARY

The present invention overcomes one or more of the foregoing problems and other shortcomings, drawbacks, and challenges of conventional ammonia synthesis. While the invention will be described in connection with certain embodiments, it will be understood that the invention is not limited to these embodiments. To the contrary, this invention includes all alternatives, modifications, and equivalents as may be included within the scope of the present invention.

According to an embodiment of the present invention, a method for electrolytically converting molecular nitrogen ($N_2$) to ammonia ($NH_3$) in an electrochemical cell comprising an anode, a cathode, and an alkaline electrolyte is provided. The method comprises exposing an anode comprising a first conducting component to a molecular hydrogen ($H_2$) containing fluid at a first pressure and first temperature, wherein the first conducting component is active toward adsorption and oxidation of $H_2$; exposing a cathode comprising a second conducting component to a molecular nitrogen ($N_2$) containing fluid at a second pressure and second temperature, wherein the second conducting component is active toward adsorption and reduction of $N_2$ to form $NH_3$; and applying a voltage between the anode exposed to the $H_2$-containing fluid and the cathode exposed to the molecular $N_2$-containing fluid so as to facilitate adsorption of hydrogen onto the anode and adsorption of nitrogen onto the cathode; wherein the voltage is sufficient to simultaneously oxidize the $H_2$ and reduce the $N_2$. The electrolytic method is further performed with the first and second pressures independently equal to or less than about 10 atmospheres (atm) to about 1 atm; and with the first and second temperatures greater than about 25° C. and less than about 205° C.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

DETAILED DESCRIPTION OF VARIOUS EMBODIMENTS

An electrochemical method and apparatus for synthesizing ammonia in an alkaline media are disclosed in various embodiments. However, one skilled in the relevant art will recognize that the various embodiments may be practiced without one or more of the specific details or with other replacement and/or additional methods, materials, or components. In other instances, well-known structures, materials, or operations are not shown or described in detail to avoid obscuring aspects of various embodiments of the present invention.

Similarly, for purposes of explanation, specific numbers, materials, and configurations are set forth in order to provide a thorough understanding. Nevertheless, the embodiments of the present invention may be practiced without specific details. Furthermore, it is understood that the illustrative representations are not necessarily drawn to scale.

Reference throughout this specification to "one embodiment" or "an embodiment" or variation thereof means that a particular feature, structure, material, or characteristic described in connection with the embodiment is included in at least one embodiment of the invention, but does not denote that they are present in every embodiment. Thus, the appearances of the phrases such as "in one embodiment" or "in an embodiment" in various places throughout this specification are not necessarily referring to the same embodiment of the invention. Furthermore, the particular features, structures, materials, or characteristics may be combined in any suitable manner in one or more embodiments. Various additional layers and/or structures may be included and/or described features may be omitted in other embodiments.

Additionally, it is to be understood that "a" or "an" may mean "one or more" unless explicitly stated otherwise.

Various operations will be described as multiple discrete operations in turn, in a manner that is most helpful in understanding the invention. However, the order of description should not be construed as to imply that these operations are necessarily order dependent. In particular, these operations need not be performed in the order of presentation. Operations described may be performed in a different order than the described embodiment.

Various additional operations may be performed and/or described operations may be omitted in additional embodiments.

Figure 1:
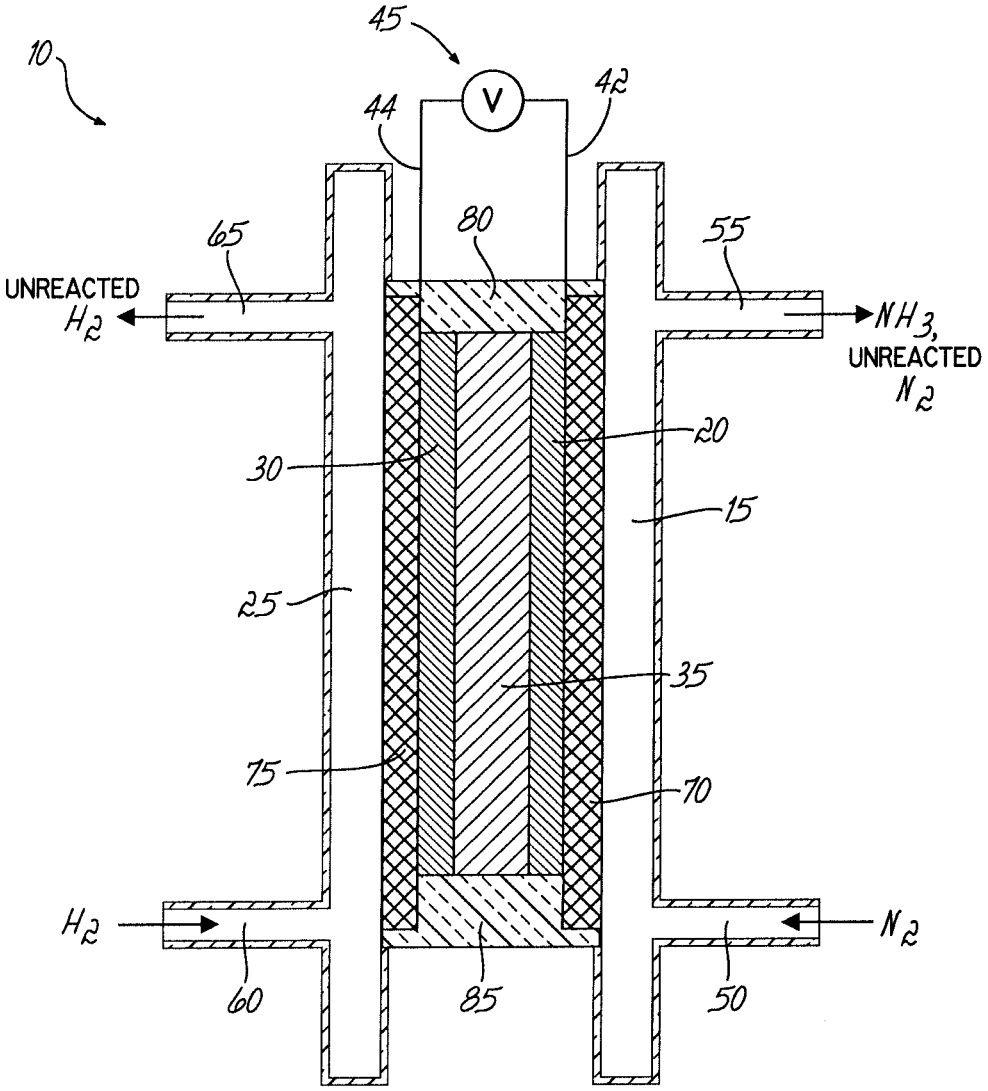
FIG. 1 is a diagrammatical view of a simplified electrolytic cell configured for flow cell processing, in accordance with an embodiment of the present invention.

FIG. 1 is a diagrammatic depiction of a simplified electrochemical cell 10 configured for flow cell processing to achieve convert molecular nitrogen ($N_2$) to ammonia ($NH_3$). The simplified electrochemical cell 10 comprises a cathodic chamber 15 containing a cathode electrode 20, an anodic chamber 25 containing an anode electrode 30, wherein the cathodic chamber 15 and the anodic chamber 25 are physically separated from each other by a separator 35. However, while also serving as a physical barrier between the cathode electrode 20 and the anode electrode 30, the separator 35 allows the transport of ions between the cathodic chamber 15 and the anodic chamber 25. The cathode electrode 20 and the anode electrode 30 are configured with an electrical connection therebetween via a cathode lead 42 and an anode lead 44 along with a voltage source 45, which supplies a voltage or an electrical current to the electrochemical cell 10.

The cathodic chamber 15 comprises an inlet 50 by which a nitrogen ($N_2$) containing fluid enters and an outlet 55 by which ammonia ($NH_3$) and unreacted nitrogen exit. Similarly, the anodic chamber 25 comprises an inlet 60 by which a hydrogen ($H_2$) containing fluid enters and an outlet 65 by which water vapor and unreacted hydrogen exit. Each of the cathodic and anodic chambers 15, 25 may further comprise gas distibutors 70, 75, respectively. The electrochemical cell 10 may be sealed at its upper and lower ends with an upper gasket 80 and a lower gasket 85.

In accordance with embodiments of the present invention, the cathode electrode 20 comprises a substrate and a conducting component that is active toward adsorption and reduction of $N_2$. At the cathode electrode 20 the reduction of nitrogen gas to ammonia takes place according to the following reaction:

$$N_2+6H_2O+6e^-\rightarrow 2NH_3+6OH^- \qquad \text{Equation (4)}$$

The reduction reaction of nitrogen gas shown in Equation (4) takes place at a theoretical potential of −0.77 V vs. standard hydrogen electrode (SHE). Therefore, in order to favor the conversion of nitrogen to ammonia potentials more negative than −0.77 V vs. SHE must be applied, while minimizing the water reduction reaction (which takes place at potentials equal or more negative than −0.82 vs. SHE).

In accordance with embodiments of the present invention, the substrate may be constructed of high surface area materials so as to increase the available surface area for the cathodic conducting component. Additionally, the substrate may be compatible with an alkaline media, i.e., the alkaline electrolyte. As used herein, "alkaline" means the pH of the media or electrolyte is at least about 8. For example, the pH may be 9, 10, 11, 12, or more. Non-limiting examples of suitable substrates include conductive metals, carbon fibers, carbon paper, glassy carbon, carbon nanofibers, carbon nanotubes, nickel, nickel gauze, Raney nickel, alloys, etc. The selected substrate should be compatible with the alkaline media or electrolyte.

In accordance with embodiments of the present invention, the cathode electrode substrate is coated with a conducting component, which is a material that is active for the adsorption and reduction of nitrogen according to Equation (4). Active catalysts include metals such as platinum (Pt), iridium (Ir), ruthenium (Ru), palladium (Pd), rhodium (Rh), nickel (Ni), iron (Fe), copper (Cu), and their combinations. When a combination of one or more metals is used for the conducting component of the cathode electrode 20, the metals can be co-deposited as alloys as described in U.S. Pat. Nos. 7,485,211 and 7,803,264, and/or by layers as described in U.S. Pat. No. 8,216,956, wherein the entirety of these disclosures are incorporated by reference herein in their entirety. In one embodiment, where the metals are layered, the overlying layer of metal may incompletely cover the underlying layer of metal.

Water is a reactant consumed in the reduction reaction of nitrogen to form ammonia. Accordingly, the surface of the cathode electrode 20 should stay wet. One suitable manner to provide a sufficient degree of humidity to the nitrogen containing gas is to pass the gas through a humidifier. However, in order to minimize the reduction of water, nitrogen should be in excess when compared to the water (see Equation (2) for the reduction of water, which takes place at −0.82 v vs. SHE). If water is used in excess relative to nitrogen, the undesirable reduction of water (see Equation (5)) may compete with or suppress the intended reduction of nitrogen in the formation of ammonia (see Equation (1)).

$$2H_2O+2e^-\rightarrow 2OH^-+H_2 \qquad \text{Equation (5)}$$

The excess or unreacted nitrogen gas that exits the cathodic chamber 15 can be separated from the ammonia product and recirculated in the process.

Nitrogen feedstock is not particularly limited to any source and may be supplied to the nitrogen containing fluid as a pure gas and/or from air, which is approximately 80% nitrogen. Other inert gases (e.g., a carrier gas) can be present in the nitrogen containing fluid. Carbon dioxide may poison the cathodic reduction catalyst, so it should be avoided or minimized in the nitrogen-containing fluid. In one embodiment, pure nitrogen is used as the nitrogen containing fluid. In another embodiment, air, which has been passed through a carbon dioxide scrubber, is used as the nitrogen containing fluid.

To enhance the distribution of nitrogen in the cathodic chamber 15, the gas distributor 70 (e.g., screen of metals) provides channels for the nitrogen to disperse and contact the cathode 20. Wet proofing materials such as polytetrafluoroethylene (PTFE) can be included in the electrode structure (e.g., rolled, added as a thin layer) to control the permeation of the alkaline electrolyte through the electrode and minimize flooding.

In accordance with embodiments of the present invention, the anode electrode 30 comprises a substrate and a conducting component that is active toward adsorption and oxidation of hydrogen. At the anode electrode 30, the oxidation of hydrogen gas in an alkaline media or electrolyte takes place according to the following reaction:

$$3H_2+6OH^- \rightarrow 6H_2O+6e^- \qquad \text{Equation (6)}$$

The hydrogen oxidation reaction shown in Equation (6) takes place at a theoretical potential of −0.82 V vs. standard hydrogen electrode (SHE). Therefore, in order to favor the conversion of hydrogen, potentials more positive than −0.82 V vs. SHE must be applied.

In accordance with embodiments of the present invention, the anode electrode substrate may be constructed of a high surface area material so as to increase the available surface area for the anodic conducting component. Additionally, the anode electrode substrate may be compatible with an alkaline media, i.e., the alkaline electrolyte. Non-limiting examples of suitable substrates include conductive metals, carbon fibers, carbon paper, glassy carbon, carbon nanofibers, carbon nanotubes, nickel, nickel gauze, Raney nickel, alloys, etc. The selected substrate should be compatible with the alkaline media or electrolyte.

In accordance with embodiments of the present invention, the anode electrode substrate is coated with a conducting component, which is a material that is active for the adsorption and oxidation of hydrogen according to Equation (6). Active catalysts include metals such as platinum (Pt), iridium (Ir), ruthenium (Ru), palladium (Pd), rhodium (Rh), nickel (Ni), iron (Fe), and their combinations. When a combination of one or more metals is use for the conducting component of the anode electrode 30, the metals can be co-deposited as alloys and/or by layers, as described above. In one embodiment, where the metals are layered, the overlying layer of metal may incompletely cover the underlying layer of metal.

In accordance with embodiments of the present invention, a hydrogen containing fluid is the preferred reacting chemical in the anodic chamber 25. Other inert gases (e.g., a carrier gas) can be present in the hydrogen containing fluid mixture. In one embodiment, pure hydrogen is used as the hydrogen containing fluid. The excess hydrogen gas can be recirculated in the process.

Gas distribution channels (e.g., screen of metals) can be added to the anodic chamber to enhance the distribution of the gas among the anodic chamber 25. Wet proofing materials such as polytetrafluoroethylene (PTFE) can be included in the electrode structure (rolled, added as a thin layer) to control the permeation of the electrolyte through the electrode and avoid flooding.

In accordance with embodiments of the present invention, an alkaline electrolyte is used in the electrochemical cell 10. The electrolyte may be a liquid and/or a gel electrolyte. Examples of electrolytes include hydroxide salts, such as potassium hydroxide (KOH) or sodium hydroxide (NaOH), or mixtures of hydroxide salts and polyacrylic acid gels, such as KOH/polyacrylic acid gel. The electrolyte may flow through the cell or be used as a stationary media or coating. The pH of the alkaline electrolyte may be about 8 or greater. For example, an alkaline electrolyte comprising an aqueous solution of a hydroxide salt may have a concentration of the hydroxide salt from about 0.5 M to about 9 M. In one example, the alkaline electrolyte comprises a 5 M solution of KOH. Additionally, other alkaline electrolytes may be used provided that they are compatible with the catalysts, do not react with the hydrogen, nitrogen, and ammonia, and have a high conductivity.

In accordance with another embodiment, when present, the separator 35 may divide the cathodic and anodic chambers 15, 25, and physically separate the cathode electrode 20 and the anode electrode 30. Exemplary separators include anion exchange membranes and or thin polymeric films that permit the passage of anions.

In accordance with embodiments of the present invention, the electrochemical cell 10 can be operated at a constant voltage or a constant current. While the electrochemical cell 10 in FIG. 1 is shown in a flow cell configuration, which can operate continuously, the present invention is not limited thereto. For example, the electrochemical ammonia synthesis process in accordance with another embodiment of the present invention may be conducted in a batch configuration.

The overall electrolytic cell reaction for the synthesis of ammonia from nitrogen and hydrogen is given by Equation (1). Therefore, the applied cell voltage at standard conditions (Temperature=25° C., and Pressure=1 atm) should be equal to or lower than about 0.059 V to favor the synthesis of ammonia. The value of the applied voltage varies with the temperature, for example at about 205° C. the applied voltage may be equal to or lower than about −0.003 V (where the cell transitions from galvanic at 25° C. to electrolytic at 205° C.). In accordance with embodiments of the present invention, the pressure of the cell can be in a range from about 1 atm to about 10 atm.

EXAMPLES

Example 1

Operating Cell Voltage

Figure 2:
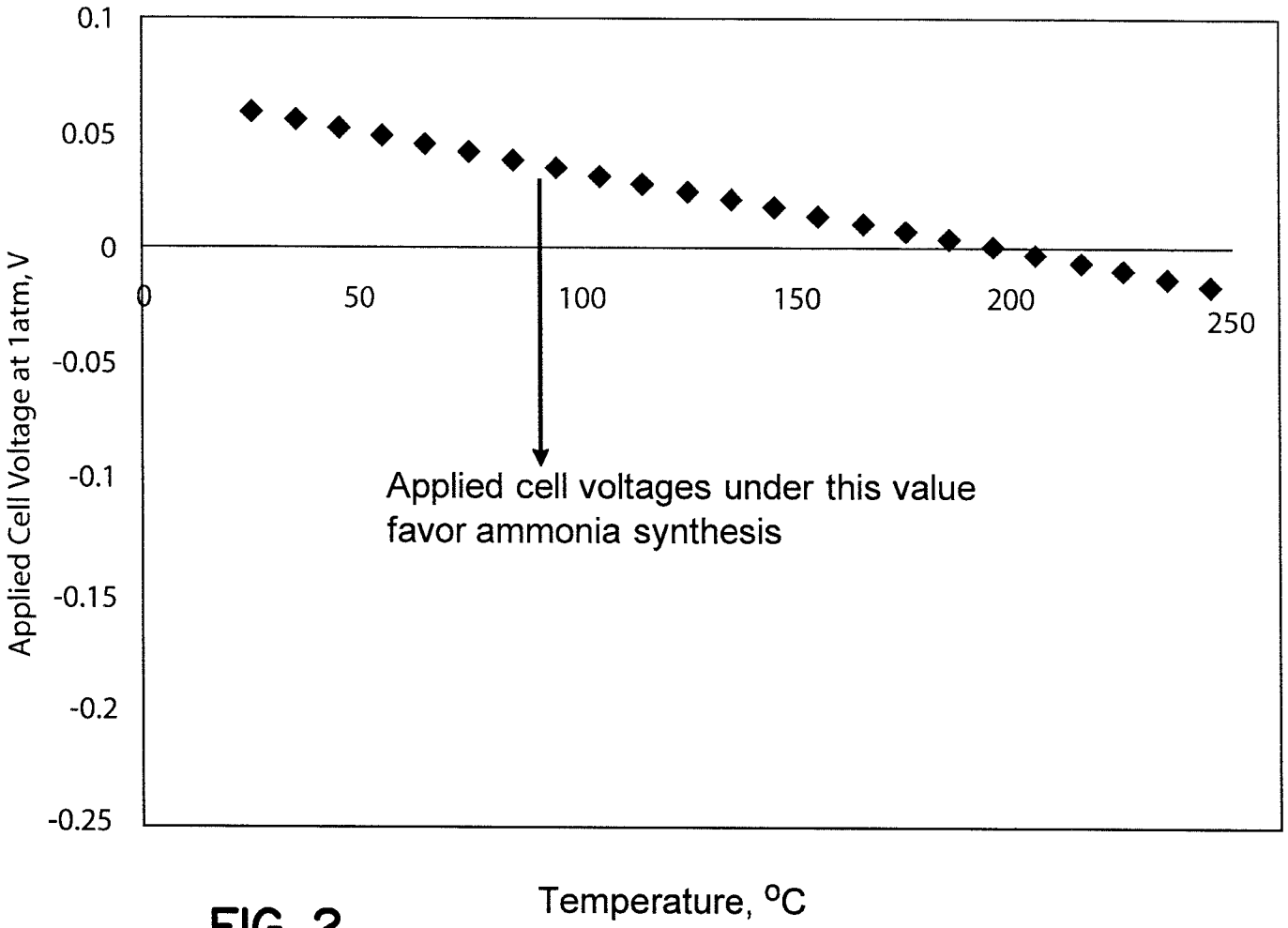
FIG. 2 is a graph of voltage (volts) versus temperature (degrees Celcius) showing theoretical operating cell voltage at different temperatures and 1 atm to favor the production of ammonia, in accordance with an embodiment of the present invention.

FIG. 2 presents a plot of the theoretical operating cell voltage, at different temperatures and at 1 atm of pressure, which favors the production of ammonia. As shown in FIG. 2, at temperatures above 195° C., the electrochemical cell 10 transitions from a galvanic cell (positive voltage) to an electrolytic cell (negative voltage). In accordance with embodiments of the present invention, the applied potential to favor the production of ammonia should be equal to or more negative than the thermodynamic voltage (as indicated in FIG. 2). Thus, in accordance with an embodiment, the electrochemical method of forming ammonia includes maintaining the voltage equal or more negative than a temperature dependent thermodynamics voltage for the production of ammonia. The higher the overpotential (difference between the thermodynamics potential shown in FIG. 2 and the applied cell voltage) the lower the faradaic efficiency for the production of ammonia, due to the hydrogen evolution reaction shown in Equation 2.

Example 2

Ammonia Synthesis

Figure 3:
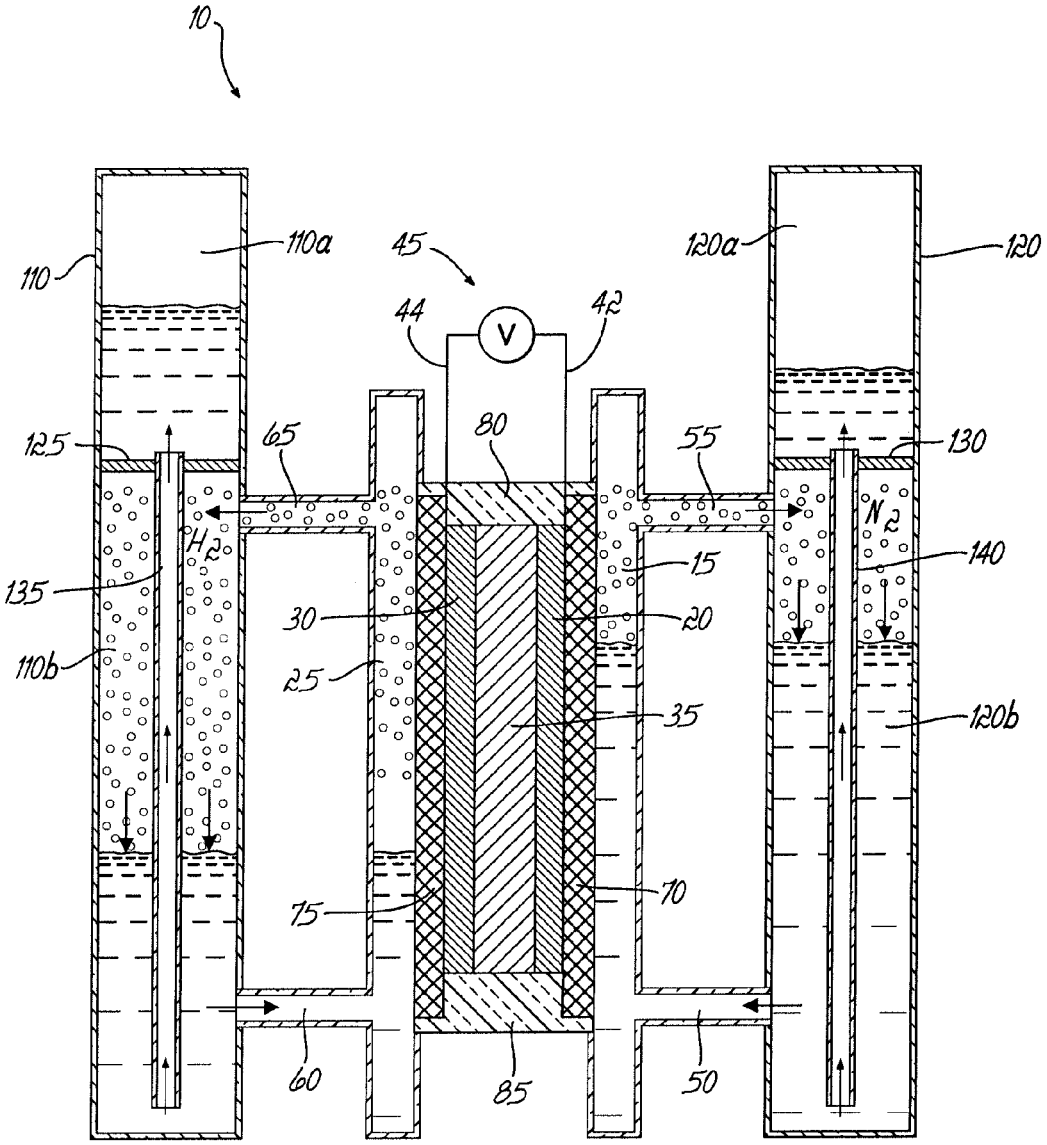
FIG. 3 is a perspective diagrammatical view of a simplified electrochemical cell assembly configured for batch processing, in accordance with another embodiment of the present invention.

An electrochemical cell assembly 100 for demonstrating the synthesis of ammonia, in accordance with an embodiment of the present invention, is shown in FIG. 3. The electrochemical cell 10 of FIG. 1 can be fluidly coupled to two columns, which are used for the collection of gases by liquid displacement. In this batch configuration, the anode column 110 contains a solution of 5 M KOH, while the cathode column 120 contains a solution of 5 M KOH/1 M $NH_3$. Each of the columns 110, 120 comprise an upper chamber (110*a*, 120*a*), a lower chamber (110*b*, 120*b*), and a divider plate 125, 130. The upper (110*a*, 120*a*) and lower (110*b*, 120*b*) chambers are fluidly coupled with a displacement tube 135, 140, respectively, which permits displacement of liquid therebetween. The lower chamber 110*b* of anode column 110 is fluidly coupled to the inlet 60 and outlet 65. The lower chamber 120*b* of cathode column 120 is fluidly coupled to the inlet 50 and the outlet 55. The cathode electrode 20 and the anode electrode 30 may be constructed from carbon paper electrodes that are electroplated with Pt—Ir, which may be co-deposited by following the procedures described in U.S. Pat. Nos. 7,485,211 and 7,803,264, to provide a loading of 5 mg/cm$^2$. The electrodes may be separated by a Teflon membrane, which allows the transport of $OH^-$ ions.

Prior to applying current to the electrochemical cell 10, the lower chambers 110*b*, 120*b* are substantially filled with their respective electrolyte solutions, which substantially fills the cathodic chamber 15 and the anodic chamber chamber 25 of the electrochemical cell 10. Upon application of reversed polarity potential to the electrodes, which effectively inverts the cathode and the anode electrodes, electrolysis of ammonia to form hydrogen and nitrogen is performed, as described in U.S. Pat. No. 7,485,211. More specifically, 1) hydrogen ($H_2$) gas is generated in chamber 25 and displaces a portion of the 5 M KOH electrolyte contained in lower chamber 110*b* into upper chamber 110*a*; and 2) nitrogen ($N_2$) gas is generated in chamber 15 and displaces a portion of the 5 M KOH/1 M $NH_3$ contained in lower chamber 120*b* into upper chamber 120*a*.

Accordingly, in a first phase, a constant current of 100 mA (of inverted potential) was applied to the electrochemical cell 10 and the electrolysis of ammonia to form $N_2$ and $H_2$ was performed. The temperature of the cell was kept at ambient temperature (25° C.). The electrolysis experiment was performed until about 15 ml of $H_2$ gas and about 5 ml of $N_2$ gas were collected in the two chambers 110*b*, 120*b*, as shown in FIG. 3. Under these conditions the cell operated as an electrolytic cell.

Figure 4:
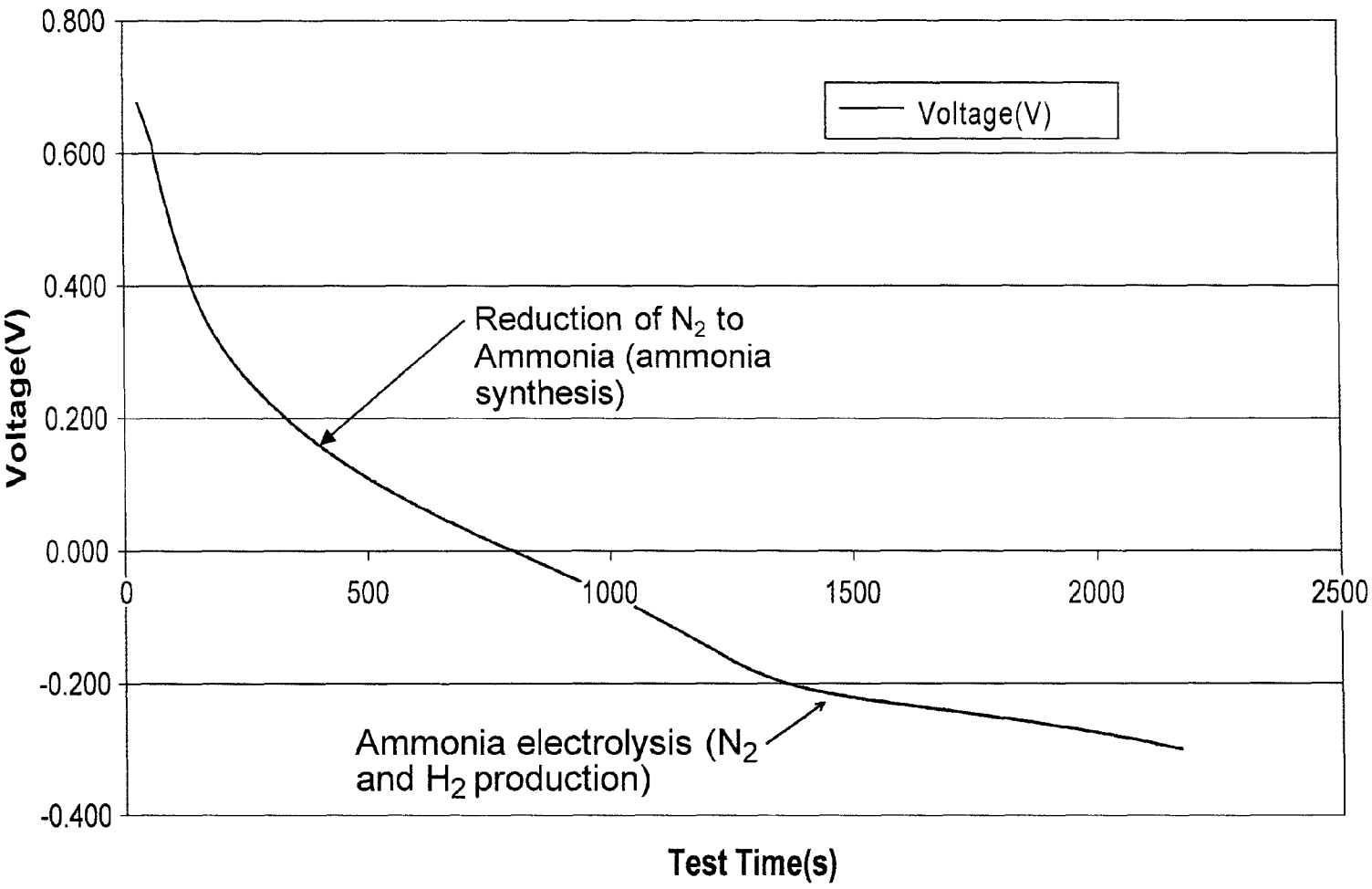
FIG. 4 is a polarization curve of voltage (volts) versus time (seconds) for the synthesis of ammonia at 5 mA and 25° C., in accordance with an embodiment of the present invention.

After sufficient volumes of hydrogen (15 ml) and nitrogen (5 ml) gas were produced, the polarity of the cell was reversed, and a current of 5 mA was drawn from the cell at ambient temperature (25° C.). FIG. 4 shows the results of the polarization of the cell at 5 mA. After approximately 14 minutes of operation, the $H_2$ and the $N_2$ in the different compartments 110*b*, 120*b* of the electrochemical cell 10 were consumed according to the stoichiometry described in Equation (4), indicating the feasibility of the synthesis of ammonia. The voltage in the cell decreased as a function of time. Without being bound by any particular theory, it is hypothesized that the observed drop in the cell voltage of the ammonia synthesis cell was caused by a less than optimal contact of the gases/electrolyte with the electrodes of the cell and by the consumption of the reactants ($N_2$ and $H_2$). As the gases were consumed, the cell voltage turned to a negative value favoring the reverse reaction to Equation (4), which is also known as ammonia electrolysis.

Example 3

Yield and Faradaic Efficiency

Based on the current drawn during the synthesis of ammonia (5 mA), the ammonia production rate is estimated at $1.06\times10^{-3}$ g/hr, while the theoretical amount that could have been produced based on the hydrogen consumption in the first 14 minutes of the reaction is $2.98\times10^{-2}$ g/hr, which represents an ammonia yield of about 3.5%.

The ammonia production rate of $1.73\times10^{-4}$ mol/s m$^2$ (at the low voltage shown in FIG. 4) is higher than any other value reported in the literature, e.g., $1.13\times10^{-4}$ mol/s m$^2$ at 2 V was obtained using proton conduction in a solid-state electrochemical cell, as reported in R. Liu, G. Xu, Comparison of Electrochemical Synthesis of Ammonia by Using Sulfonated Polysulfone and Nafion Membrane with $Sm_{1.5}Sr_{0.5}NiO_4$, *Chinese Journal of Chemistry* 28, 139-142 (2010). The observed high yield of ammonia is surprising at the low operating temperatures and pressures of the present method. The Haber-Bosch process requires 500° C. and 150-300 bar for the synthesis of ammonia with a yield of 10-15%.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope of the general inventive concept.

What is claimed is:

1. A method for electrolytically converting molecular nitrogen ($N_2$) to ammonia ($NH_3$) in an electrochemical cell comprising an anode, a cathode, and an alkaline electrolyte, the method comprising:

exposing an anode comprising a first conducting component to a molecular hydrogen ($H_2$) containing fluid at a first pressure and first temperature, wherein the first conducting component is active toward adsorption and oxidation of $H_2$;

exposing a cathode comprising a second conducting component to a molecular nitrogen ($N_2$) containing fluid at a second pressure and second temperature, wherein the second conducting component is active toward adsorption and reduction of $N_2$ to form $NH_3$; and applying a voltage between the anode exposed to the $H_2$-containing fluid and the cathode exposed to the molecular $N_2$-containing fluid so as to facilitate adsorption of hydrogen onto the anode and adsorption of nitrogen onto the cathode; wherein the voltage is sufficient to simultaneously oxidize the $H_2$ and reduce the $N_2$; wherein the first and second pressures are independently equal to or less than about 10 atmospheres (atm)

to about 1 atm; and wherein the first and second temperatures are greater than about 25° C. and less than about 205° C.

2. A method according to claim 1, further comprising maintaining the voltage equal or more negative than a temperature dependent thermodynamics voltage for the production of ammonia.

3. The method of claim 1, wherein the voltage is applied as a constant voltage.

4. The method of claim 1, wherein the first conducting component of the anode comprises a metal selected from platinum, iridium, ruthenium, palladium, rhodium, nickel, iron, or a combination thereof.

5. The method of claim 4, wherein the first conducting component of the anode comprises a combination of the metals, which are co-deposited as alloys or deposited by layers.

6. The method of claim 1, wherein the second conducting component of the cathode comprises a metal selected from platinum, iridium, ruthenium, palladium, rhodium, nickel, iron, copper, or a combination thereof.

7. The method of claim 6, wherein the second conducting component of the cathode comprises a combination of the metals, which are co-deposited as alloys or deposited by layers.

8. The method of claim 1, wherein the alkaline electrolyte has a pH equal to or greater than about 8.

9. The method of claim 1, wherein the alkaline electrolyte comprises a hydroxide salt.

10. The method of claim 1, wherein the alkaline electrolyte comprises an alkali metal or alkaline earth metal salt of a hydroxide.

11. The method of claim 1, wherein the alkaline electrolyte has a hydroxide concentration from 0.1 M to about 9 M.

12. The method of claim 1, wherein the alkaline electrolyte contains potassium hydroxide in a concentration from about 0.1 M to about 9 M.

13. The method of claim 9, wherein the alkaline electrolyte further comprises a polymeric gel.

14. The method of claim 13, wherein the polymeric gel comprises a polyacrylic acid.

15. The method of claim 1, wherein the electrochemical cell further comprises a separator.

16. The method of claim 15, wherein separator comprises an anion exchange membrane.

* * * * *